US007493936B2

(12) United States Patent
Nakata et al.

(10) Patent No.: US 7,493,936 B2
(45) Date of Patent: Feb. 24, 2009

(54) CONTINUOUS CASTING METHOD

(75) Inventors: Hitoshi Nakata, Kakogawa (JP); Ko Kobayashi, Kakogawa (JP); Kazuki Sumida, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 11/548,114

(22) Filed: Oct. 10, 2006

(65) Prior Publication Data

US 2007/0125513 A1 Jun. 7, 2007

(30) Foreign Application Priority Data

Nov. 30, 2005 (JP) ..... 2005-346643

(51) Int. Cl.
*B22D 11/07* (2006.01)
*B22D 11/108* (2006.01)

(52) U.S. Cl. ..... 164/472; 164/459

(58) Field of Classification Search ..... 164/459, 164/472

See application file for complete search history.

(56) References Cited

FOREIGN PATENT DOCUMENTS

| | | | |
|---|---|---|---|
| JP | 2000-158106 | | 6/2000 |
| JP | 2002-35896 | | 2/2002 |
| JP | 2003-305542 | | 10/2003 |
| JP | 2003305544 A | * | 10/2003 |
| JP | 2004-98092 | | 4/2004 |

* cited by examiner

*Primary Examiner*—Kuang Lin
(74) *Attorney, Agent, or Firm*—Oblon, Spivak, McClelland, Maier & Neustadt, P.C.

(57) ABSTRACT

A first inclined surface and a second inclined surface are provided on the inside of a mold to constitute a so-called two-step tapered mold. A mold powder is adjusted to have a total content of CaO component and $SiO_2$ component of not less than 50 wt %, and a content of F component of not more than 11 wt %. The inclination rates of the first and second inclined surfaces are set according to the basicity or solidification temperature of the powder to be used. The pore area of molten steel discharge ports of a dipping nozzle is set to not less than 2500 $mm^2$ to less than 6400 $m^2$. The discharge angle of the molten steel discharge ports is set, based on the horizontal, obliquely downward to not less than 10° to not more than 35°. According to such a continuous casting method, solidification delay at angle parts of a bloom can be suppressed.

2 Claims, 7 Drawing Sheets

CONTINUOUS CASTING METHOD

BACKGROUND OF THE INVENTION

1. Field of the Invention

The present invention relates to a continuous casting method and, more specifically, to a technique for continuously casting a bloom or billet.

2. Description of the Related Arts

As this type of technologies, each of Japanese Patent Laid-Open Nos. 2003-305542 and 2002-35896 discloses a casting mold having different tapers.

Japanese Patent Laid-Open No. 2003-305542 describes that since adaptation of a mold to multistage-tapered shape leads to the consumption of mold powder and the resulting sufficient exhibition of lubricating function of the powder, breakout (hereinafter referred also to as BO for short) or bloom cracking can be prevented.

Japanese Patent Laid-Open No. 2004-35896 discloses application of a multistage-tapered mold to casting of so-called billet.

Japanese Patent Laid-Open Nos. 2004-98092 and 2000-158106 disclose techniques related to mold powder.

Japanese Patent Laid-Open No. 2004-98092 relates to a continuous casting method of hyper-peritectic medium carbon steel. According to this document, breakout of constraint (seizure of solidified shell to mold), which tends to occur in low-speed casting of this carbon steel, can be prevented by appropriately setting the chemical composition or physical properties of mold powder.

Japanese Patent Laid-Open No. 2000-158106 also discloses a suitable chemical composition of mold powder similarly to the above-mentioned Japanese Patent Laid-Open No. 2004-98092, wherein main components of this mold powder are regulated to CaO, $SiO_2$ and $Al_2O_3$, and the basicity thereof is also mentioned.

However, each of the documents described above independently just devised a countermeasure, paying attention to a specified one of a plurality of factors which deteriorate the surface quality of bloom, and no comprehensive measures have been taken under the present circumstances.

SUMMARY OF THE INVENTION

From the above-mentioned points, a main object of the present invention is to provide a continuous casting method capable of suppressing solidification delay, particularly, at angle parts of bloom.

The continuous casting method according to the present invention is applied to continuous casting of a bloom having a substantially rectangular section with the length of each edge constituting the sectional circumference being not less than 120 mm and an aspect ratio being not less than 1.0 to not more than 2.0, at a casting rate (Vc: [m/min]) of not less than 0.5 [m/min] to not more than 2.0 [m/min]. It is premised to use, as mold powder to be added to a mold, a mold powder having a total content of CaO component and $SiO_2$ component of not less than 50 wt % and a content of F component of not more than 11 wt %.

The features of the continuous casting method of the present invention are as follows.

A first inclined surface and a second inclined surface differed in inclination rate are provided on the inside of a mold in order from top to down.

When the basicity of the mold powder is less than 1.1, or when the solidification temperature of the mold powder is lower than 1100° C., the inclination rate of the first inclined surface (TRu: [%/m]) and the inclination rate of the second inclined surface (TRd: [%/m]) are set to ranges satisfying the following expressions (1) and (2). When the basicity of the mold powder is not less than 1.1, and when the solidification temperature of the mold powder is not lower than 1100° C., the inclination rate of the first inclined surface and the inclination rate of the second inclined surface are set to ranges satisfying the following expressions (3) and (4).

The boundary position between the first inclined surface and the second inclined surface is set to be distant downwardly not less than 0.2 m and not more than 0.4 m based on the upper end of the mold.

At least two molten steel discharge ports are bored in lower end portions of a dipping nozzle for pouring molten steel to the mold, and the pore area of the molten steel discharge ports is set to from not less than 2500 $mm^2$ to less than 6400 $mm^2$.

When the casting rate is not more than 0.7 [m/min], the discharge angle of the molten steel discharge port is set obliquely downward, based on the horizontal, to from not less than 10° to not more than 35°.

$$4.4-1.95\times Vc \leqq TRu \leqq 6.06-2.5\times Vc \quad (1)$$

$$0.92-0.3\times Vc \leqq TRd \leqq 1.18-0.4\times Vc \quad (2)$$

$$2.23-1.05\times Vc \leqq TRu \leqq 3.18-1.4\times Vc \quad (3)$$

$$0.55-0.2\times Vc \leqq TRd \leqq 0.77-0.25\times Vc \quad (4)$$

According to the above-mentioned continuous casting method, unevenness of shell thickness, more specifically, the solidification delay particularly at angle parts of bloom can be suppressed. Consequently, vertical cracking at angle parts of bloom can be suppressed.

The above-mentioned "basicity" means a value [−] obtained by dividing a value of the total Ca content in the mold powder converted to CaO content [wt %] by a value of the total Si content therein converted to $SiO_2$ content [wt %].

The above-mentioned "solidification temperature" means a temperature at which the mold powder changes from liquid phase to solid phase.

The above-mentioned "inclination rate" is determined based on the following expression (A).

$$(\text{Inclination Rate})=((W\text{inlet}-W\text{outlet})/W\text{outlet})/H\times 100 \quad (A)$$

wherein W represents a mold width, with W inlet being a mold width at the upper end of the inclined surface, and W outlet being a mold width at the lower end of the inclined surface, and H is a vertical distance of the inclined surface.

The above-mentioned the "pore area of molten discharge port" means the opening area of the molten steel discharge port in the boring-directional view of the molten steel discharge port (refer to FIG. 3).

The above-mentioned the "discharge angle of molten steel discharge port" means an inclination of the center line of the molten discharge port, which is based on the horizontal.

When continuously casting a bloom having a substantially rectangular section using a single mold and with at least first and second casting rates, if the range of inclination rates of the first or second inclined surfaces determined based on a second casting rate overlaps with the range of inclination rates of the first or second inclined surfaces determined based on the first casting rate, the inclination rate of the first inclined surface or said second inclined surface is set within said overlap of the ranges.

When continuously casting a bloom having a substantially rectangular section using a single mold and with at least first and second casting rates, if the range of inclination rates of the first or second inclined surfaces determined based on the second casting rate does not overlap with the range of inclination rates of the first or second inclined surfaces determined based on the first casting rate, the inclination rate of said first inclined surface or said second inclined surface is determined based on:

a larger casting rate being prioritized as the range of inclination rate of said first inclined surface or said second inclined surface, a range satisfying the expression (3) being prioritized over a range satisfying the expression (1), and a range satisfying the expression (4) being prioritized over a range satisfying the expression (2).

According to this, drawing resistance of bloom to the mold, wear of the mold, corner snagging at angle parts of bloom, and the like can be suppressed, while suppressing the solidification delay particularly at angle parts of bloom as much as possible.

BEST MODE FOR CARRYING OUT THE INVENTION

Figure 4:
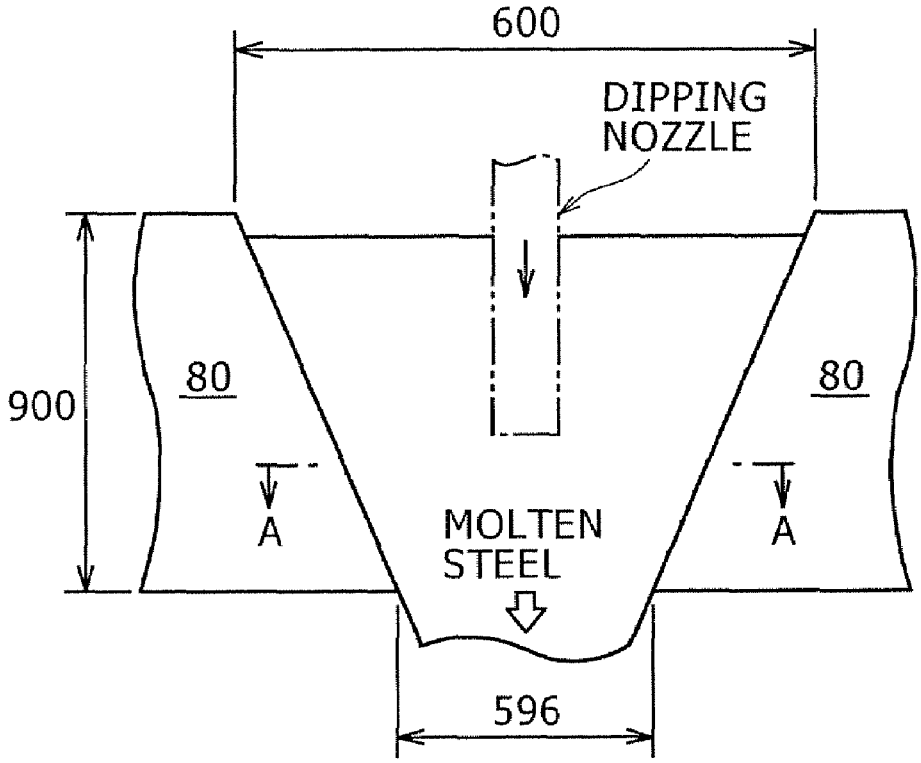
FIG. 4 is a vertical sectional view of a bloom mold which is conventionally used.
Figure 5:
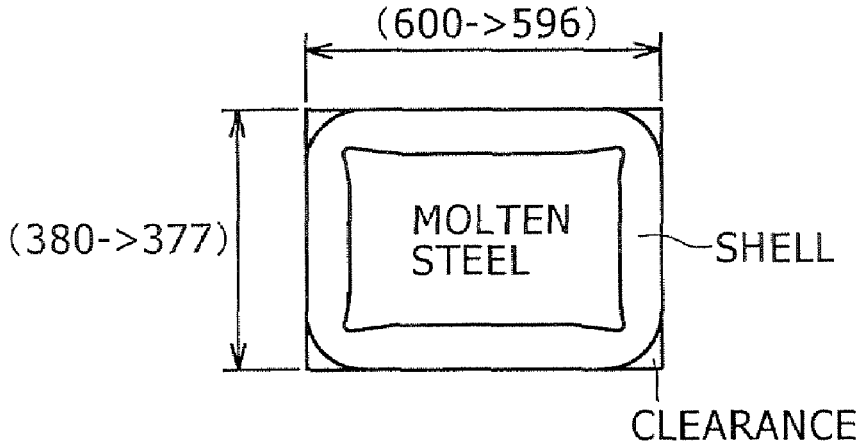
FIG. 5 is a sectional view taken along line A-A in FIG. 4.

FIG. 4 is a vertical sectional view of a bloom mold which has been conventionally used, and FIG. 5 is a sectional view taken along line A-A in FIG. 4.

As shown in FIG. 4, a uniform inclined surface narrowed downwardly is formed on the inside of a conventional mold 80, for example, with a vertical length of 900 mm and long-side lengths of 600 mm at the upper end and 596 mm at the lower end. Short-side lengths thereof are 380 mm at the upper end and 377 mm at the lower end (refer to FIG. 5). According to this, the inner surface of the mold 80 can be fitted as closely as possible to the outer surface of a bloom to be solidified and contracted.

However, it was actually difficult to uniformly closely fit the inner surface of the mold 80 to the outer surface of the bloom. Although the outer surface of the bloom was almost closely fitted to the inner surface of the mold 80 due to formation of the uniform inclined surface on the inside of the mold 80 as described above and by the static pressure effect of molten steel, clearance was formed between the bloom and the mold 80, as shown in FIG. 5, particularly at angle parts. The heat transfer between the bloom and the mold 80 at the angle parts was remarkably reduced due to this clearance, whereby solidification delay was caused, resulting in surface quality defects such as so-called corner cracking.

By the way, steel kinds are roughly classified to hypo-peritectic steel with a carbon content of less than about 0.17 wt % and hyper-peritectic steel with a carbon content of about 0.17 wt % or more. The quality defects could occur in any steel kind, but were particularly frequent in the hypo-peritectic steel. This is attributable to that the hypo-peritectic steel causes $\delta$ to $\gamma$ transformation with a large volume change in a strong shell after perfect solidification, different from the hyper-peritectic steel, and this modification causes large contraction of the shell.

The above-mentioned trouble was more frequent in a casting condition with a lower casting rate and/or as the bloom sectional dimension is larger. This is attributable to that the solidification contraction volume is increased more in a casting condition with a lower casting rate, or as the bloom sectional dimension is larger. Despite this, the difference in solidification contraction volume was hardly reflected in conventional mold designs.

As the earnest studies for solving the above problem and improving the surface quality of bloom, the present inventors paid attention to the following items which are closely interconnected.

The first point is the inner surface shape of the mold. Concretely, the inner surface shape of mold is changed from a uniformly inclined surface as in the past to a multistage-inclined surface.

Figure 6:
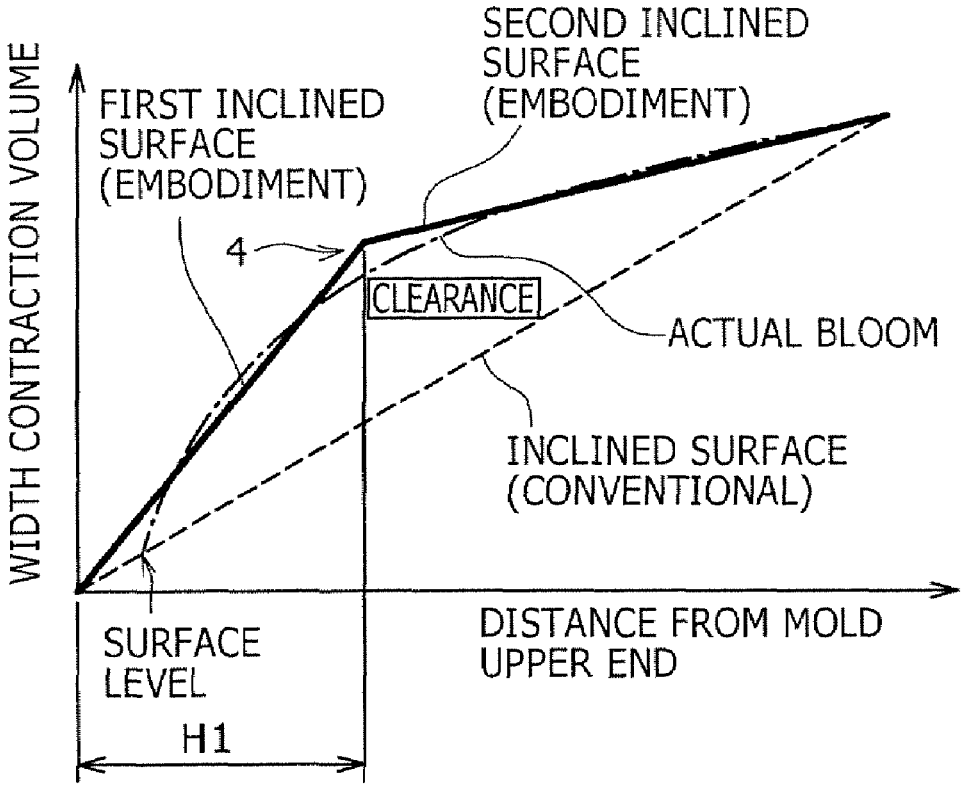
FIG. 6 is a view showing inclination of mold inner surface (broken line), and contraction of bloom width (chain line)

The inclination of a conventional mold inner surface (broken line) and the contraction of bloom width (chain line) are shown in FIG. 6. According to this drawing, the contraction volume of bloom width has the property of changing (dulling) in accordance with growing (thickening) of a shell having heat insulating effect, and never uniformly changes as the conventional mold inner surface. Therefore, the inner surface shape is changed to the multistage-inclined surface so that the inclination of inner surface of the mold is matched to the actual contraction mode of the bloom width as much as possible.

The second point is the component of the mold powder to be used for continuous casting.

The third point is the relevancy of casting conditions such as the kind of the mold powder and the casting rate with the inclination rate of the inclined surface.

The fourth point is the reversing flow of molten steel which has the property of fluctuating the molten steel surface in addition to the role of supplying heat to the vicinity of the molten steel surface.

Figure 1:
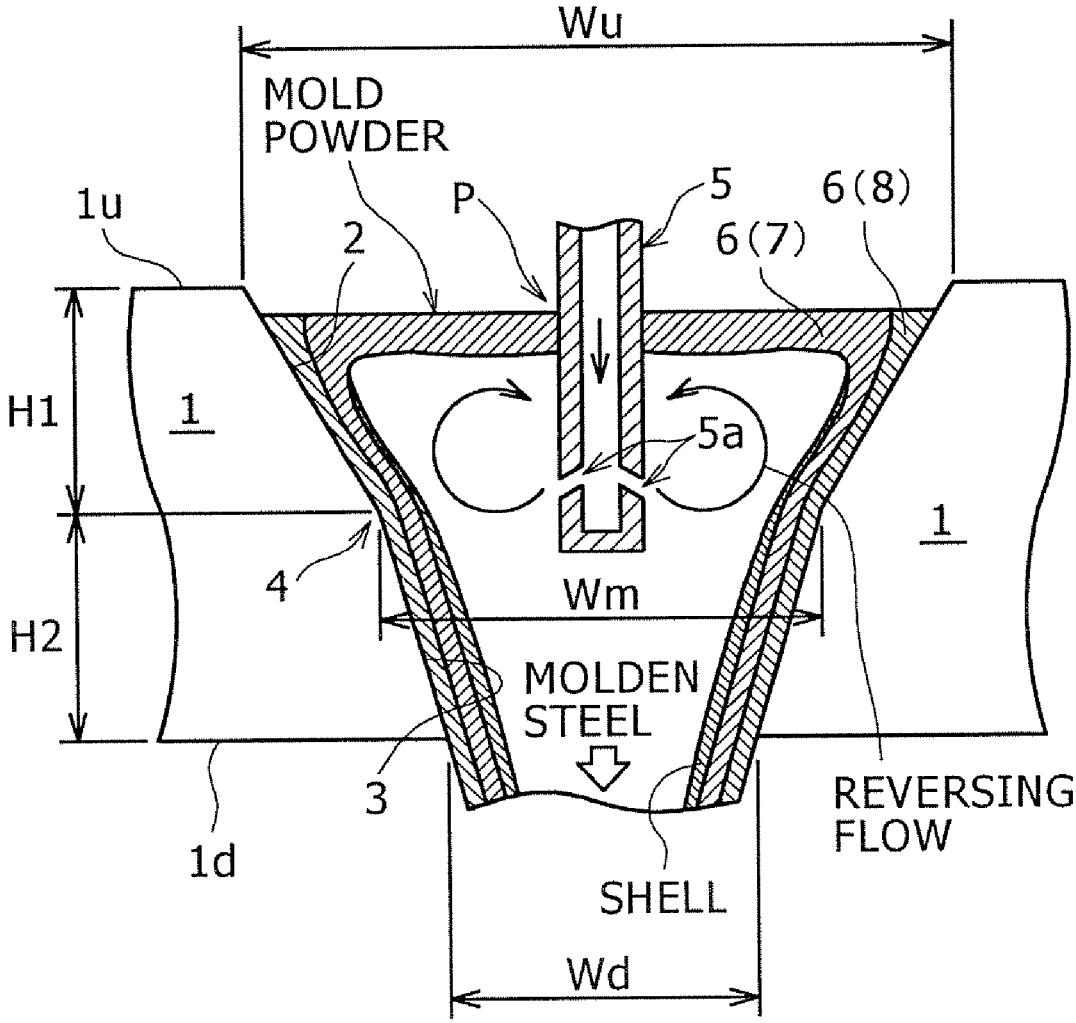
FIG. 1 is a vertical sectional view of a mold.
Figure 2:
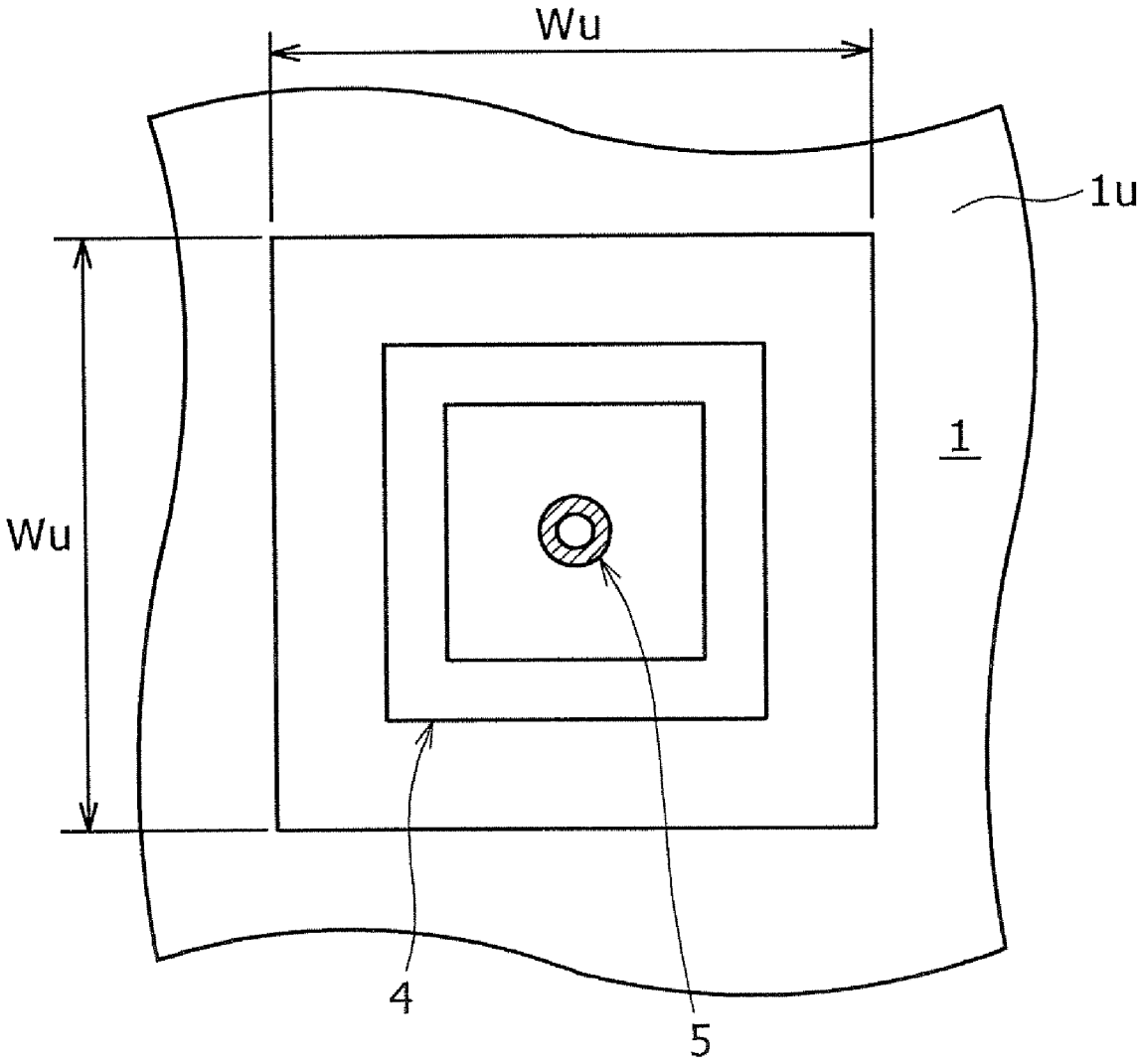
FIG. 2 is a top view of the mold.

A preferred embodiment of the present invention will be described in reference to the drawings. FIG. 1 is a vertical sectional view of a mold and FIG. 2 is a top view of the mold.

In this embodiment, a bloom intended by a mold 1 has a substantially rectangular sectional shape with the length of each side constituting the circumference of the section being not less than 120 mm and an aspect ratio being not less than 1.0 to not more than 2.0 (or so-called bloom or billet). Both the shape and the size of such a bloom are determined according to circumstances of real operation.

From the first viewpoint, a first inclined surface 2 and a second inclined surface 3 differed in inclination rate are formed on the inside of the mold 1 in order from top to down, as shown in FIG. 1. According to this, the inner surface of the mold 1 can be easily closely fitted to the outer surface of the bloom which is not uniformly solidified and contracted as shown in FIG. 6. The inclination rate will be described later.

In the mold 1, the boundary position 4 between the first inclined surface 2 and the second inclined surface 3 is set to be distant downwardly, based on a mold upper end 1*u*, not less than 0.2 m and not more than 0.4 m for the reason described below. The first inclined surface 2 and the second inclined surface 3 are preferably smoothly connected to each other with a slight roundness in the boundary position 4.

Although the mold 1 in this embodiment is a so-called 2-step tapered mold, a structure further including an additional third inclined surface is also conceivable. However, the 2-step tapered mold is most preferable from the circumstances of real operation such as mold working cost and maintenance management.

The mold 1 is adapted so that molten steel successively stored therein can be agitated by the effect of electromagnetic force. According to this, since the reversing flow of molten steel described later can be smoothly circulated within the mold 1, heat can be uniformly supplied to the whole molten steel surface, so that a mold powder described below can be stably made into molten slag (melted).

The mold 1 is adapted to pour the molten steel thereto through a dipping nozzle 5. Two molten steel discharge ports 5*a* are bored in lower end portions of the dipping nozzle 5.

A proper mold powder 6 is added to the surface of molten steel within the mold 1. According to this, the mold powder 6 is melted in a part contacting with the molten steel to form a powder film 7 of liquid phase (hereinafter referred also simply to as liquid-phase powder 7), and solidified in a part contacting with the mold 1 to form a powder film of solid phase 8 (hereinafter also referred simply to as solid-phase powder 8).

The mold powder 6 (7, 8) exhibits functions such as mold internal lubrication, mold internal cooling control (molten steel heat extraction control), heat insulation and oxidation prevention of molten steel, removal of nonmetallic inclusions, and the like.

The mold powder 6 to be added in this embodiment is preliminarily component-adjusted so as to have a total content of CaO component and $SiO_2$ component of not less than 50 wt % and a content of F (fluorine) of not more than 11 wt % (the second viewpoint).

The reason for setting the total content of CaO component and $SiO_2$ component to not less than 50 wt % as described above is that the mold powder 6 can exhibit preferable effects for promoting the heat insulation and oxidation prevention of molten steel, absorption of bubbles or inclusions in molten steel, and ensuring of the lubricating property of the mold inner wall with the shell in the state of the liquid phase powder 7 or the solid phase powder 8.

Crystal precipitation of cuspidine ($3CaO$, $2SiO_2$, $CaF_3$) to the powder is used for heat control. A single powder of this composition is advantageous for the heat control because the cuspidine is directly precipitated from the liquid phase, but still problematic in lubricating property because of inclusion of solid phase in the liquid phase. Therefore, the F content of the mold powder is set to not more than 11% so as to be lower than the F content in pure cuspidine composition. When the F content is higher than this, the precipitation gets in primary crystallization zone of $CaF_2$, which cannot be said preferable crystals from the point of heat control. An excessively high F content is disadvantageous for corrosion of facilities of a continuous casting machine, or has an environmental demerit such as increased elution of fluorine.

The mold powder 6 may include about 1.5 to 10% of C component having the function of adjusting the melting rate.

The mold powder 6 may include an alkali metal oxide such as $Na_2O$ $Li_2O$ or $K_2O$, or $Al_2O_3$. The alkali metal oxide or the like have the function of adjusting the viscosity or solidification temperature of the mold powder 6.

In the present invention, the composition range of the mold powder (the total content of CaO component and $SiO_2$ component of not less than 50 wt %, and the content of F (fluorine) component of not more than 11 wt %) is just a precondition. The present invention does not intend to limit the composition range of the mold powder to be optimized from any point of view. Therefore, the compositions of generally used mold powders are within the above-mentioned range. For example, among existing materials, a one composed of CaO: 32.2%, $SiO_2$: 35.4, $Na_2O$: 9.9%, MgO: 3.7%, F: 5.0% (solidification temperature: 1140° C.) as a rapid-cooling powder and a one composed of CaO: 40.4%, $SiO_2$: 33.3%, $Na_2O$: 8.0%, MgO: 0.7%, and F: 5.6% (solidification temperature: 1165° C.) as a slow-cooling powder can be used. In each case, the principle feature of the present invention is that a condition such as inclination rate of mold inner surface is changed depending on the kind of the powder to be used.

In this embodiment, the casting rate (Vc) of bloom is set to not less than 0.5 [m/min] to not more than 2.0 [m/min] for reasons in real operation.

The lower limit of the casting rate is set to 0.5 [m/min], for example, for convenience of productivity, and the upper limit is set to 2.0 [m/min] for the purpose of surely forming a shell with sufficient thickness within the mold from the point of prevention of breakout (molten steel leakage).

The contraction mode of bloom is largely changed depending on not only the casting rate but also the heat extracting characteristic of the mold powder 6 to be used. Therefore, it is rational to set the inclination rate of the first inclined surface 2 and the inclination rate of the second inclined surface 3 from case to case according to the mold powder 6 to be used.

Namely, when the mold powder 6 to be added in casting has a basicity of less than 1.1 or a solidification temperature of lower than 1100° C., the inclination rate of the first inclined surface 2 (TRu: [%/m]) and the inclination rate of the second inclined surface 3 (TRd: [%/m]) are set within ranges satisfying the following expressions (1) and (2).

$$4.4-1.95\times Vc \leqq TRu \leqq 6.06-2.5\times Vc \quad (1)$$

$$0.92-0.3\times Vc \leqq TRd \leqq 1.18-0.4\times Vc \quad (2)$$

On the other hand, when the mold powder 6 has a basicity of 1.1 or more and solidification temperature of 1100° C. or higher, the inclination rate of the first inclined surface 2 and the inclination rate of the second inclined surface 3 are set within ranges satisfying the following expressions (3) and (4).

$$2.23-1.05\times Vc \leqq TRu \leqq 3.18-1.4\times Vc \quad (3)$$

$$0.55-0.2\times Vc \leqq TRd \leqq 0.77-0.25\times Vc \quad (4)$$

The "basicity" means a value [−] obtained by dividing a value of the total Ca content in the mold powder converted to CaO content [wt %] by a value of the total Si content therein converted to $SiO_2$ content [wt %].

The "solidification temperature" means a temperature at which the mold powder changes from liquid phase to solid phase.

The shell is more rapidly cooled (more rapidly heat-extracted) as the "basicity" and "solidification temperature" are lower, since the crystals to be precipitated in the solid-phase powder 8 are reduced, resulting in reduction in heat transfer resistance. On the other hand, the shell is more slowly cooled (more slowly heat-extracted) as the "basicity" and "solidification temperature" are higher, because the thickness of the solid phase powder 8 having crystals is increased, while the liquid phase powder 7 with good lubricating property is insufficient, and the heat transfer resistance is consequently increased.

In the present specification, hereinafter, the mold powder 6 with a basicity of less than 1.1 or a solidification temperature of lower than 1100° C. is called a rapid-cooling powder 6*f*, and the mold powder 6 with a basicity of 1.1 or more or a solidification temperature of 1100° C. or higher is called slow-cooling powder 6*s*. Generally, the rapid-cooling powder 6*f* is used for casting of low carbon steel and hypo-peritectic steel, and the slow-cooling powder 6*s* for casting of hypo-peritectic steel.

The local heat flow rate of the rapid-cooling powder 6*f* just under the molten steel surface is larger than 2.0 $MW/m^2$, for example, when the casting rate is 1.5 m/min. On the other hand, the local heat flow rate of the slow-cooling powder 6*s* just under the molten steel surface is not more than 2.0 $MW/m^2$ when the casting rate is 1.5 m/min.

The "inclination rate" is determined based on the following expression.

$$(\text{Inclination rate})=(W\text{inlet}-W\text{outlet})/W\text{outlet})/H\times 100 \quad (A)$$

wherein W represents a mold width, with W inlet being a mold width at the upper end of the inclined surface, and W outlet being a mold width at the lower end of the inclined surface, and H is a vertical distance of the inclined surface.

Therefore, the inclination rate of the first inclined surface 2 (TRu: [%/m]) can be determined by the following expression (refer to FIG. 1).

$$TRu=((Wu/Wm)-1)/H1\times 100$$

wherein Wu is the mold width at the upper end of the mold 1, Wm is the mold width at the boundary position 4, and H1 is the vertical distance of the inclined surface 2.

Similarly, the inclination rate of the second inclined surface 3 (TRd: [%/m]) can be determined by the following expression.

$$TRd=((Wm/Wd)-1)/H2\times 100$$

wherein Wd is the mold width at the lower end of the mold 1, and H2 is the vertical distance of the second inclined surface 3.

As described above, the ranges of inclination rate of the first inclined surface 2 and the second inclined surface 3 are set based on the kind of the mold powder 6 to be used (rapid-cooling powder 6*f* or slow-cooling powder 6*s*) and the casting rate.

Figure 3:
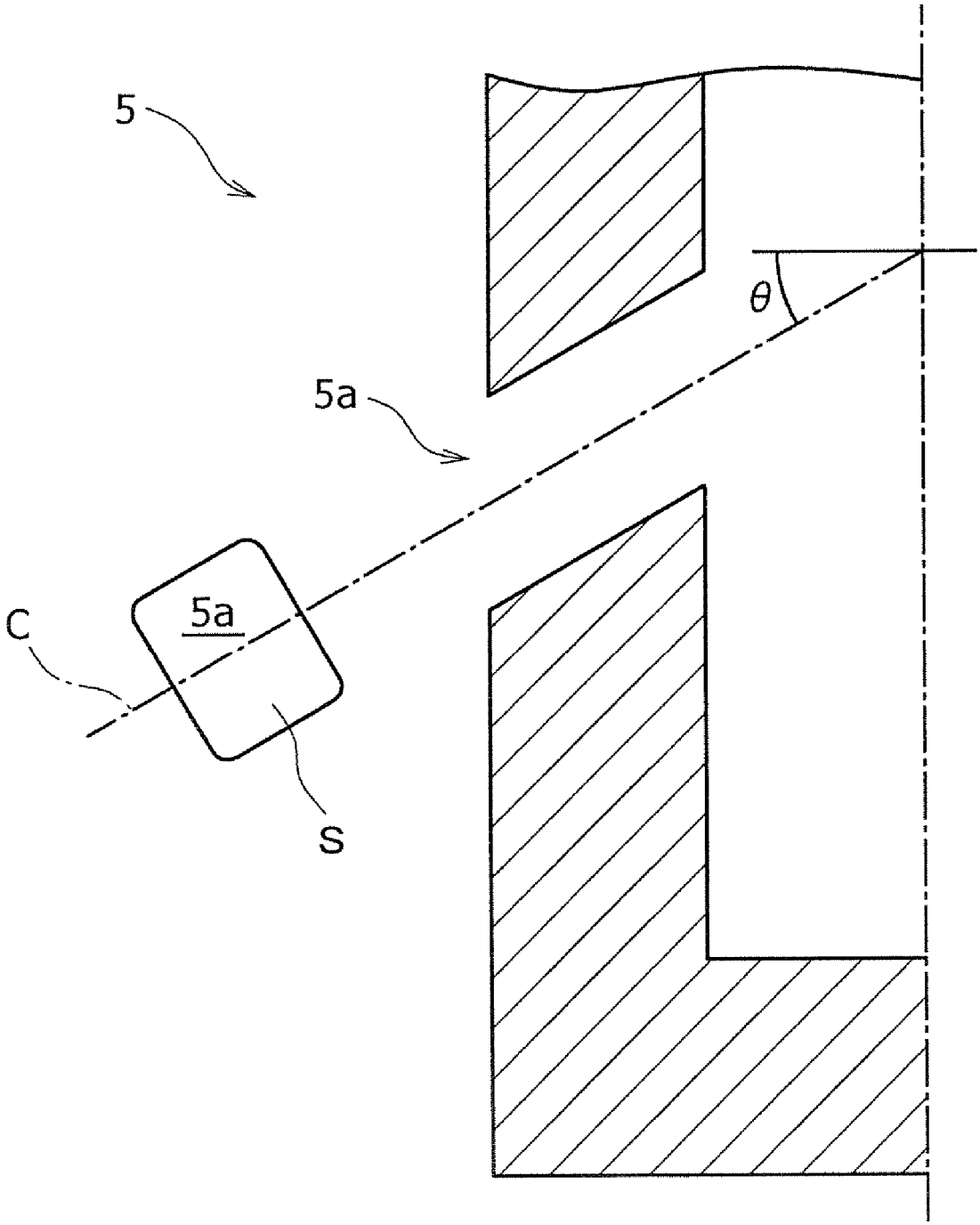
FIG. 3 is a vertical sectional view of a dipping nozzle.

The dipping nozzle 5 will be then described. FIG. 3 is a vertical sectional view of the dipping nozzle.

As shown in this drawing, molten steel discharge ports 5*a*, 5*a* have a substantially rectangular sectional shape, and are bored to have a predetermined discharge angle θ. The "discharge angle θ" means the inclination of the center line C of the molten steel discharge port 5*a*, 5*a* based on the horizontal, with the vertically upward direction being positive and the downward direction being negative based on the horizontal as 0° (reference) if not otherwise specified.

The discharge angle θ of the molten steel discharge port 5*a*, 5*a* is set, more specifically, to not less than −5° to not more than 35° when the casting rate is not more than 0.7 [m/min]. In other words, in this case, the molten steel discharge port 5*a*, 5*a* is bored, based on the horizontal, with an obliquely upward inclination of not less than 0° to not more than 5° or with an obliquely downward inclination of not less than 0° to not more than 35°.

On the other hand, the discharge angle θ is set to not less than 10° to not more than 35° when the casting rate is more than 0.7 [m/min]. In other words, in this case, the molten steel discharge port 5*a*, 5*a* is bored, based on the horizontal, with an obliquely downward inclination of not less than 10° to not more than 35°.

The pore area S of the molten steel discharge port 5*a*, 5*a* is set to not less than 2500 $mm^2$ to less than 6400 $mm^2$. The "pore area" means the opening area of the molten steel discharge port 5*a*, 5*a* in the boring-directional view of the molten steel discharge port 5*a*, 5*a* as shown in FIG. 3.

The discharge angle θ and the pore area S of the molten steel discharge port 5*a*, 5*a* have a close relation with the reversing flow of molten steel as shown by the curved arrow in FIG. 1.

More specifically, as the discharge angle θ is smaller and/or as the pore area S is smaller, the discharge direction of the reversing flow gets closer to the molten steel surface side and/or the discharge flow velocity of the reversing flow is increased more, whereby further more heat is supplied to the molten steel surface, whereas the molten steel surface is more violently fluctuated.

Similarly, as the discharge angle θ is larger and/or as the pore area S is larger, the discharge direction of the reversing flow is more distant from the molten steel surface side and/or the discharge flow velocity of the reversing flow is reduced more, whereby the molten steel surface becomes gentle with minimized surface fluctuation, whereas the heat to be supplied to the molten steel surface is reduced.

It is clarified by verification tests (Tables 5 to 7) which were made by the present inventors that this surface fluctuation or formation of deckle (solidified matter, massy matter) described later has great influence on the above-mentioned solidification delay.

Therefore, the discharge angle θ and the pore area S are rationally set as described above so that sufficient heat can be supplied to the vicinity of the molten steel surface for the purpose of preventing the formation of deckles, and so that the fluctuation of molten steel surface is not excessive.

The operation of this embodiment will be described.

As shown in FIG. 1, the molten steel continuously pored into the mold 1 through the dipping nozzle 5 starts solidifying from the circumference by the cooling effect of the inner surface of the mold 1 to form a shell, and also is drawn downwardly at a constant casting rate. The above-mentioned mold powder 6 (liquid-phase powder 7 and solid-phase powder 8) intrudes to between the mold 1 and the shell and exhibits the functions such as lubricating action.

At this time, the mold 1 is operated with addition of appropriate oscillation (vibration) for continuing a stable casting work while preventing the seizure of the bloom to the mold. Therefore, oscillation trace is substantially periodically left on the cast loom.

By the way, the bloom is rapidly contracted in the initial stage of casting (on the upper end side of the mold), as shown by the chain line in FIG. 6, since the shell is still rather thin, and heat extraction by the mold 1 is severe. This rapid solidification contraction is settled (dulled) with time in accordance with the growth of the shell.

When the surface level within the mold lowers by change of operation conditions, and the start point of solidification is out of the boundary position 4 between the first inclined surface 2 and the second inclined surface 3, the position causing sudden thermal contraction is shifted from the area of the first inclined surface 3 set as a sharp inclined surface, and the above-mentioned clearance that causes solidification delay is formed between the bloom and the mold 1 (refer to also FIG. 5).

On the other hand, since the molten steel surface height is intentionally raised and lowered to avoid local welding loss of the dipping nozzle 5 (refer to P in FIG. 1), or raised and lowered due to the surface level fluctuation, the point where the sudden solidification contraction is settled is also raised and lowered in the same manner.

Consequently, the boundary position 4 is set to be distant downwardly, based on the mold upper end 1*u*, not less than 0.2 m in order to surely settle the sudden solidification contraction before reaching the boundary position 4, in other words, to sufficiently and surely grow the shell in the stage before reaching the boundary position 4.

The minimum distance 0.2 m of the boundary portion 4 from the mold upper end 1*u* is set considering change of the thickness of the mold powder layer.

However, when the boundary position 4 is set to be distant more than 0.4 m downwardly based on the mold upper end 1*u*, the inclination of the surface changes where there is no influence of the large solidification contraction in the initial stage, whereby the inclination of the mold does not match to the actual contraction of the bloom. Accordingly, the boundary position 4 is set to be distant not more than 0.4 m downwardly based on the mold upper end 1*u*.

When continuous casting in a plurality of different casting conditions is executed by use of a single mold 1, the continuous casting is preferably performed in the following method from the point of real operation.

Namely, when a duplicated range is present in a range group of inclination rates determined independently based on the plurality of casting conditions, respectively, the inclination rate of the first inclined surface 2 or the second inclined surface 3 is set within this duplicated range.

On the other hand, when no duplicated range is present in the range group of inclination rates determined independently based on the plurality of casting conditions, respectively, a range of inclination rate determined based on a larger casting rate is prioritized (adapted) as the range of inclination rate of the first inclined surface 2 or the second inclined surface 3. Namely, a range satisfying the expression (3) is prioritized (adapted) over a range satisfying the expression (1), and a range satisfying the expression (4) is prioritized (adapted) over a range satisfying the expression (2).

The inclination rate is set based on a condition capable of minimizing the bloom contraction.

According to this, the above-mentioned drawing resistance of bloom to the mold 1, wear of the mold 1, corner snagging at angle parts of bloom can be suppressed while surely ensuring suppression of the solidification delay at the angle parts of bloom as much as possible.

The drawing resistance, the wear, and the corner snagging are closely interacted.

Vc is also included in the plurality of casting conditions. When a plurality of Vc values are present, the Vc value to be used for determining the inclination rate is the maximum one of them, and it is applied to the expressions (3) and (4). Considering the stability of casting, it is preferred to determine the condition so that the inclination rate can be minimized as much as possible.

Although the preferred embodiment of the present invention was described above, the embodiment can be modified and executed as follows.

For example, the mold 1 can be constituted in a so-called mold width as-needed variable type capable of changing the mold widths Wu, Wm, and Wd as needed. According to this, further flexible responses to various casting conditions can be attained (refer to the expressions (1) to (4)).

Figure 8:
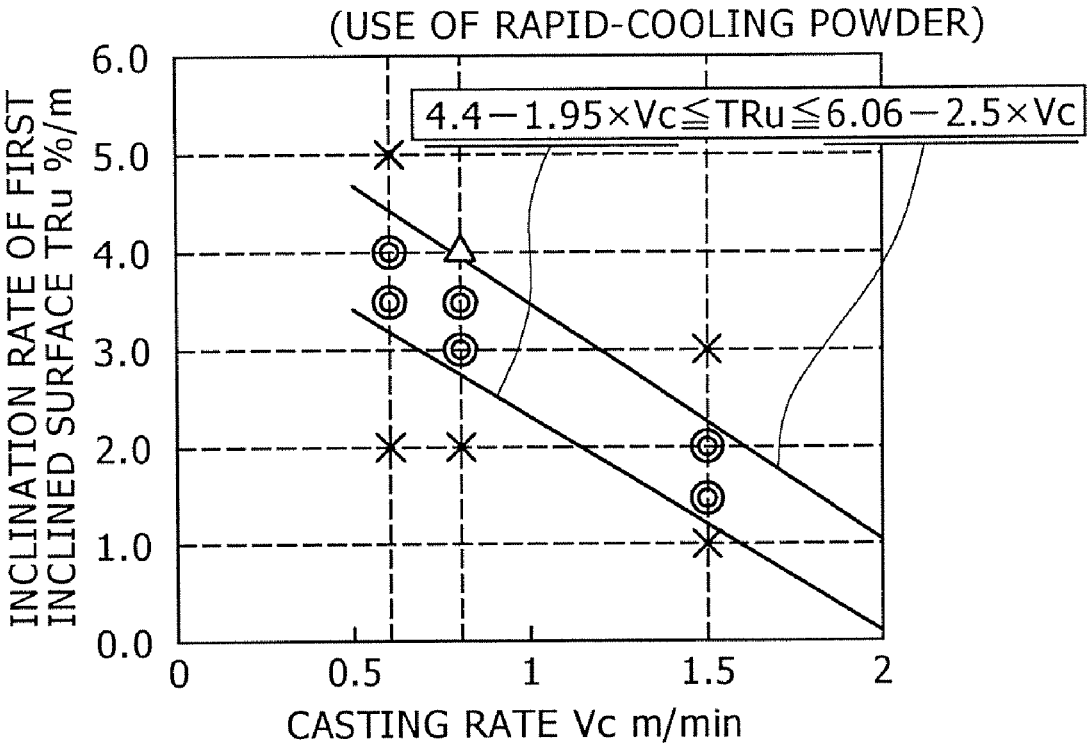
FIG. 8 is a graph showing the results of Tables 1 and 2, which are plotted, paying attention only to a first inclined surface.
Figure 9:
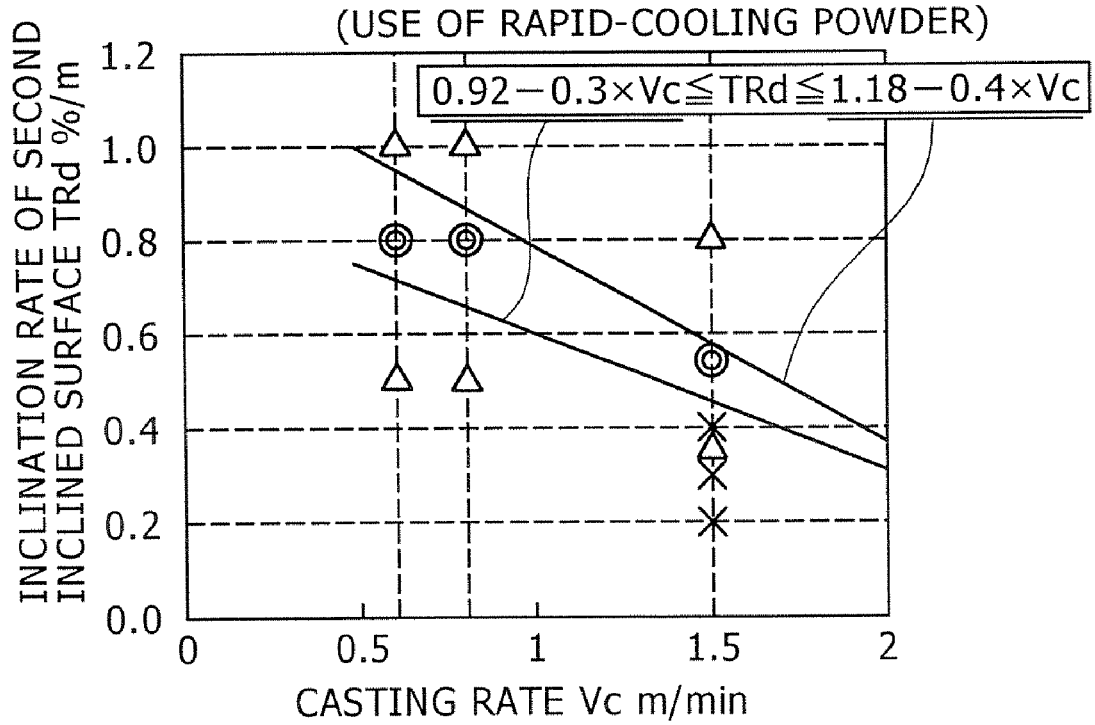
FIG. 9 is a graph showing the results of Tables 1 and 2, which are plotted, paying attention only to a second inclined surface.
Figure 10:
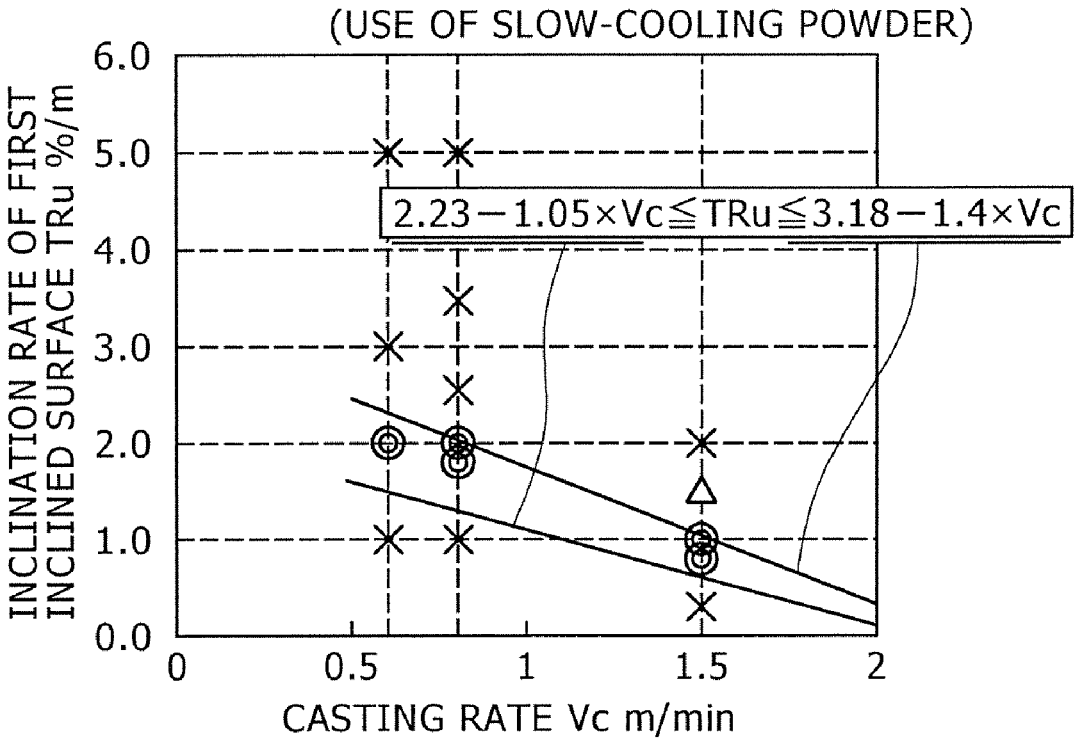
FIG. 10 is a graph showing the results Tables 3 and 4, which are plotted, paying attention only to the first inclined surface.

Although the above-mentioned embodiment was described on assumption that the first inclined surface 2 (four faces) constituting the inner surface of the mold 1 is entirely set to the same inclination rate, mutually differed inclination rates which are within the suitable ranges of inclination rate shown in FIGS. 8 and 10 can be also adapted without being limited to this. The same applies to the second inclined surface 3 (refer to FIGS. 9 and 11).

Examples of the present invention will be then described. Each of the above-mentioned numerical ranges is rationally backed up by Examples 1 to 3 described below.

EXAMPLE 1

This example is a test executed to verify the third viewpoint described above. The third viewpoint is the correlation of casting conditions such as the kind of mold powder 6 and the casting rate with the inclination of inclined surface.

In this example, the mold width at the upper end of the mold 1 (refer to FIGS. 2 and 5) was set to 600 mm×380 mm. Accordingly, the sectional aspect ratio of a bloom to be cast is about 1.6.

The rapid cooling powder **6*f* was added to the molten steel surface within the mold 1. The rapid cooling powder 6*f*** was preliminarily component-adjusted so that the basicity was larger than 0.6 and smaller than 1.1, or the solidification temperature was higher than 900° C. and lower than 1100° C.

As the steel kind to be cast, hypo-peritectic steel having a content of C component of about 0.12 wt % was used.

The discharge angle θ of molten steel discharge ports **5*a*, 5*a* of the dipping nozzle 5 was set to 20°. Namely, the molten steel discharge ports 6*a*, 5*a*** were bored downwardly at 20° based on the horizontal.

The pore area S of the molten steel discharge ports **5*a*, 5*a*** was set to 3600 $mm^2$.

The dipping depth of the dipping nozzle 5 to molten steel was set to about 80 to 130 mm.

Further, the difference between the temperature of molten steel in a tundish which temporarily retains molten steel to be poured into the mold 1 before the pouring and the liquid phase line temperature was set to about 5 to 25° C.

Further, the mold 1 was provided with an electromagnetic agitation means (coil or the like) not shown for agitating the molten steel in the mold 1, and the agitation power of the electromagnetic agitation means was set so that the magnetic flux density on the inner surface of the empty mold 1 was about 400 to 800 Gauss.

Table 1 relates to the broad surface side of the mold 1, and Table 2 relates to the narrow surface side thereof.

The boundary position between the first inclined surface and the second inclined surface to be distant downwardly based on the upper end of the mold was 0.4 m

[Table 1]

[Table 2]

In Tables 1 and 2, the "evaluation" was made based on the degree of solidification delay. Specifically, in this example, the degree of solidification delay (%) is defined as follows, and each test was evaluated based on this degree of solidification delay.

[Definition of Degree of Solidification Delay]

Figure 7:
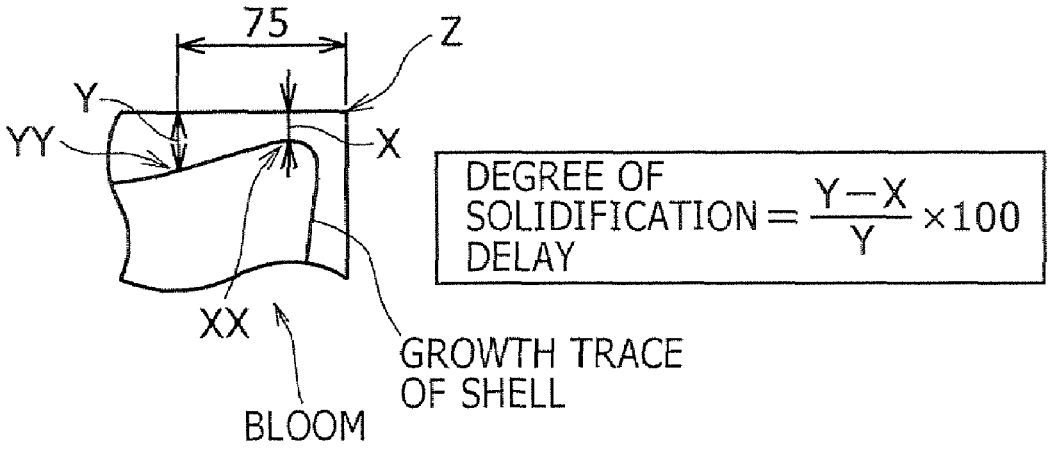
FIG. 7 is a sectional view of a bloom.

A bloom after casting is cut vertically to the longitudinal direction, and the distance from one side of a growth trace of shell, which appeared in the section as shown in FIG. 7, is measured. More specifically, distance X at a point (mark XX) where the growth trace of shell is closest to the one side, and distance Y at a point (mark YY) distant 75 mm from an angle part Z the closest to the point XX are measured.

The degree of solidification delay (%) is defined by the following expression.

$$\text{Degree of solidification delay}(\%)=100\times(Y-X)/Y$$

[Criteria for Evaluation]

A degree of solidification delay of not more than 10% was evaluated ◎ since it hardly has the risk of vertical cracking at angle parts of bloom (hereinafter referred also to as corner vertical cracking).

A degree of solidification delay of more than 10 to 20% was evaluated as ○ because of the risk of fine corner vertical cracking of less than 1 mm.

A degree of solidification delay of more than 20 to 30% was evaluated as Δ because of the risk of corner vertical cracking of not less than 1 mm.

At a degree of solidification delay of not less than 30%, the probability of corner vertical cracking of not less than 1 mm is increased. A case having a large angle of inclined surface was evaluated as x because of increased drawing resistance of the bloom to the mold or the risk of so-called corner snagging at angle parts of oscillation trace.

FIG. 8 is a graph showing the results of Tables 1 and 2, which are plotted, paying attention only to the first inclined surface, and FIG. 9 is a graph showing the results of Tables 1 and 2, which are plotted, paying attention only to the second inclined surface.

According to FIGS. 8 and 9, it is found to be preferable in use of the rapid-cooling powder **6*f* that the inclination rate of the first inclined surface 2 (TRu: [%/m]) and the inclination rate of the second inclined surface 3** (TRd: [%/m]) are within the ranges satisfying the expressions (1) and (2).

$$4.4-1.95\times Vc \leqq TRu \leqq 6.06-2.5\times Vc \quad (1)$$

$$0.92-0.3\times Vc \leqq TRd \leqq 1.18-0.4\times Vc \quad (2)$$

In FIGS. 8 and 9, evaluations of a test with the highest evaluation of a plurality of tests which were performed based on the same casting rate and the same inclination rate are typically plotted.

EXAMPLE 2

A verification test of this example is substantially the same as in Example 1, except adding the slow-cooling powder 6*s* to the molten steel surface within the mold 1 instead of the rapid-cooling powder 6*f*. The slow-cooling powder 6*s* was preliminarily component-adjusted so that the basicity was larger than 1.1 or the solidification temperature was higher than 1100° C.

Table 3 relates to the broad surface side of the mold 1, and Table 4 relates to the narrow surface side thereof.

The boundary position between the first inclined surface and the second inclined surface to be distant downwardly based on the upper end of the mold was 0.4 m

[Table 3]

[Table 4]

Figure 11:
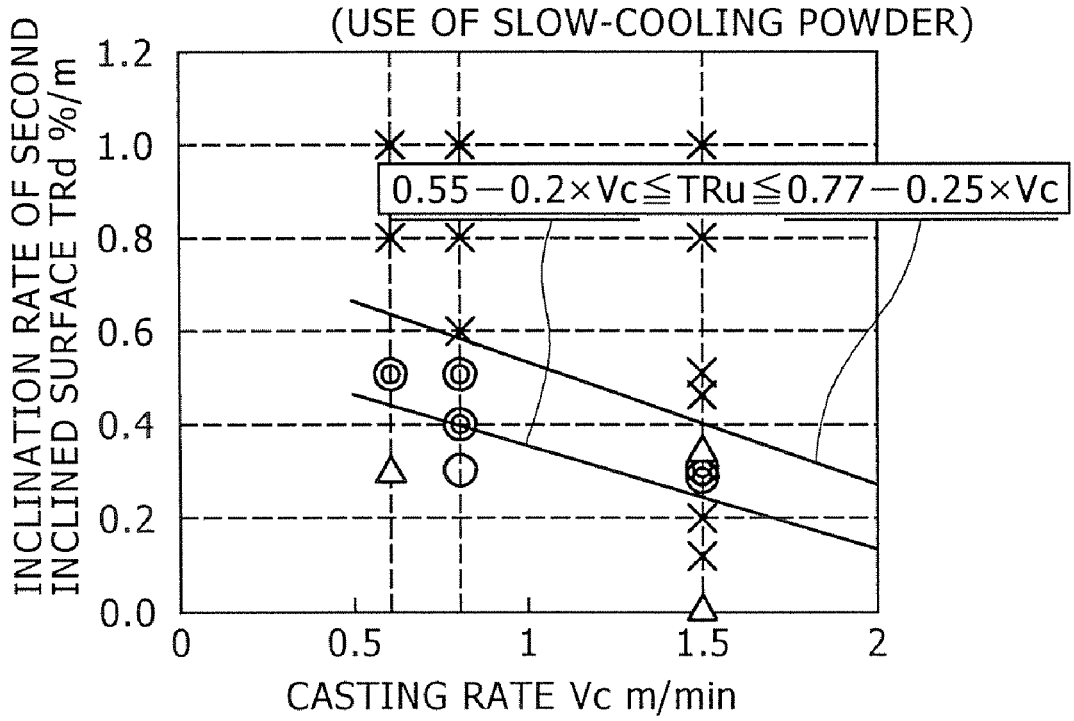
FIG. 11 is a graph showing the results of Tables 3 and 4, which are plotted, paying attention only to the second inclined surface.

FIG. 10 is a graph showing the results in Tables 3 and 4, which are plotted, paying attention only to the first inclined surface, and FIG. 11 is a graph showing the results of Tables 3 and 4, which are plotted, paying attention only to the second inclined surface.

According to FIGS. 10 and 11, it is found to be preferable in use of the slow-cooling powder 6*s* that the inclination rate of the first inclined surface 2 (TRu: [%/m]) and the inclination rate of the second inclined surface 3 (TRd: [%/m]) are within the ranges satisfying the expressions (3) and (4) described below.

$$2.23-1.05\times Vc \leqq TRu \leqq 3.18-1.4\times Vc \quad (3)$$

$$0.55-0.2\times Vc \leqq TRd \leqq 0.77-0.25\times Vc \quad (4)$$

In FIGS. 10 and 11, evaluations of a test with the highest evaluations of a plurality of tests which are performed based on the same casting rate and the same inclination rate are typically plotted.

EXAMPLE 3

This example is a test executed to verify the fourth viewpoint described above. The fourth viewpoint relates to the reversing flow of molten steel which has the property of fluctuating the molten steel surface, in addition to the role of supplying heat to the vicinity of the molten steel surface.

The verification test of this example was substantially the same as in Example 1, except adding the slow-cooling powder 6*s* to the molten steel surface within the mold 1 instead of the rapid-cooling powder 6*f*. The slow-cooling powder 6*s* was preliminarily component-adjusted so that the basicity was larger than 1.1 and smaller than 2.5, and the solidification temperature was higher than 1100° C. and lower than 1270° C.

As the steel kind to be cast in this example, hypo-peritectic steel having a content of C component of about 0.12 wt % was used similarly to in Example 1.

Tables 5, 6, and 7 relate to tests which were executed while setting, as inclinations of the first inclined surface 2 and the second inclined surface 3, substantially central values in suitable inclination rate ranges shown in FIGS. 10 and 11, upper limit values in the same range, and lower limit values in the same range, respectively.

The boundary position between the first inclined surface and the second inclined surface to be distant downwardly based on the upper end of the mold was 0.4 m

[Table 5]

[Table 6]

[Table 7]

The tests in which the surface level fluctuation for 1 minute was less than ±5 mm and the flatness of surface level was regularly less than 10 mm were evaluated as "○" in the column of molten steel surface fluctuation/drift in Tables 5 to 7, while the tests in which the surface level fluctuation was not less than ±5 mm, or the flatness of surface level was not regularly less than 10 mm were evaluated as "x".

In the tests with "x" in the column of "deckle" of Tables 5 to 7, molten steel was solidified in the vicinity of the molten steel surface to produce a solidified matter, or the mold powder 6 was not sufficiently made into molten slag (melted) in the vicinity of the molten steel surface, in addition to the production of the solidified matter, and consequently bonded with the solidified matter to form a deckle (massy matter). On the other hand, in the tests with "○", neither the solidified matter nor the deckle was formed.

The reason that the molten steel was solidified or the mold powder 6 was not sufficiently made into molten slag (melted) in the vicinity of the molten steel surface is conceivably that sufficient heat was not supplied to the vicinity of the molten steel surface.

In the "comprehensive evaluation" of Tables 5 to 7, the degree of solidification delay, the corner vertical cracking and the like were comprehensively evaluated in addition to the evaluation for the "surface level fluctuation/drift" and the production of "deckle" or the like.

As shown in Tables 5 to 7, extensive and detailed examinations were performed with respect to all cases with casting rates of 0.5 [m/min], 0.6 [m/min], 0.7 [m/min], 0.9 [m/min], 1.0 [m/min], and 1.5 [m/min].

According to Tables 5 to 7, it is found to be preferable that the pore area S of the molten steel discharge ports 5*a*, 5*a* is set to not less than 2500 $m^2$ to less than 6400 $mm^2$.

According to Tables 5 to 7, it is found that the lower limit value of the preferable range of the discharge angle θ of the molten steel discharge port 5*a*, 5*a* is increased as the casting rate is increased (in a case that the oblique downward direction is taken as positive direction based on the horizontal).

According to Tables 5 to 7, it is further found that the solidification delay which causes corner vertical cracking can be suppressed by simultaneously considering all of (1) the mold shape (two-step tapered shape), (2) the inclination rates of the inclined surfaces 2 and 3 according to heat extraction characteristic of the mold powder 6, and (3) the shape of dipping nozzle 5.

According to Tables 5 to 7, it is found that the expressions (3) and (4) showing suitable ranges of respective inclinations of the first inclined surface 2 and the second inclined surface 3 can be rationally backed up thereby, because the upper limit value and the lower limit value shown by the expressions (3) and (4) were verified, respectively, as shown in Tables 6 and 7, and the comprehensive evaluations thereof were clarified to be satisfactory.

With respect to the expressions (1) and (2), the same verification tests as in Tables 5 and 7 were carried out, whereby the expressions (1) and (2) are also rationally proofed.

TABLE 1

(Broad Surface)

| Casting Rate Vc m/min | First Inclined Surface TRu %/m | Second Inclined Surface TRd %/m | Evaluation |
|---|---|---|---|
| 0.6 | 2.0 | 0.5 | X |
| | 2.0 | 0.8 | X |
| | 2.0 | 1 | X |
| | 3.5 | 0.5 | Δ |
| | 3.5 | 0.8 | ◎ |
| | 3.5 | 1 | Δ |
| | 4.0 | 0.5 | Δ |
| | 4.0 | 0.8 | ◎ |
| | 4.0 | 1 | X |
| | 5.0 | 0.5 | X |
| | 5.0 | 0.8 | X |
| | 5.0 | 1 | X |
| 0.8 | 2.0 | 0.5 | X |
| | 2.0 | 0.8 | X |
| | 2.0 | 1 | X |
| | 3.0 | 0.5 | Δ |
| | 3.0 | 0.8 | ◎ |
| | 3.0 | 1 | Δ |
| | 3.5 | 0.5 | Δ |
| | 3.5 | 0.8 | ◎ |
| | 3.5 | 1 | X |
| | 4.0 | 0.5 | Δ |
| | 4.0 | 0.8 | Δ |
| | 4.0 | 1 | X |
| 1.5 | 2.0 | 0 | X |
| | 2.0 | 0.35 | Δ |
| | 2.0 | 0.55 | ◎ |
| | 3.0 | 0 | X |
| | 3.0 | 0.35 | X |
| | 3.0 | 0.8 | X |
| | 1.0 | 0 | X |
| | 1.0 | 0.4 | X |
| | 1.0 | 0.8 | X |

TABLE 2

(Narrow Surface)

| Casting Rate Vc m/min | First Inclined Surface TRu %/m | Second Inclined Surface TRd %/m | Evaluation |
|---|---|---|---|
| 0.6 | 2 | 0.5 | X |
| | 2 | 0.8 | X |
| | 2 | 1 | X |
| | 3.5 | 0.5 | Δ |
| | 3.5 | 0.8 | ◎ |
| | 3.5 | 1 | Δ |
| | 4 | 0.5 | X |
| | 4 | 0.8 | ◎ |
| | 4 | 1 | X |
| | 5 | 0.5 | X |
| | 5 | 0.8 | X |
| | 5 | 1 | X |
| 0.8 | 2 | 0.5 | X |
| | 2 | 0.8 | X |
| | 2 | 1 | X |
| | 2.5 | 0.5 | X |
| | 2.5 | 0.8 | X |
| | 2.5 | 1 | X |
| | 3.5 | 0.5 | Δ |
| | 3.5 | 0.8 | ◎ |
| | 3.5 | 1 | X |
| | 5 | 0.5 | X |
| | 5.0 | 0.8 | X |
| | 5 | 1 | X |
| 1.5 | 2 | 0 | X |
| | 2 | 0.35 | X |
| | 2 | 0.55 | ◎ |
| | 3 | 0.2 | X |

TABLE 2-continued (Narrow Surface)

| Casting Rate Vc m/min | First Inclined Surface TRu %/m | Second Inclined Surface TRd %/m | Evaluation |
|---|---|---|---|
| | 3 | 0.32 | X |
| | 3 | 0.8 | X |
| | 1.5 | 0.55 | ◎ |
| | 1.5 | 0.8 | Δ |
| | 1.5 | 1 | X |

TABLE 3

(Broad Surface)

| Casting Rate Vc m/min | First Inclined Surface TRu %/m | Second Inclined Surface TRd %/m | Evaluation |
|---|---|---|---|
| 0.6 | 1.0 | 0.3 | X |
| | 1.0 | 0.5 | X |
| | 1.0 | 0.8 | X |
| | 2.0 | 0.3 | Δ |
| | 2.0 | 0.5 | ◎ |
| | 2.0 | 0.8 | X |
| | 3.0 | 0.5 | X |
| | 3.0 | 0.8 | X |
| | 3.0 | 1 | X |
| | 5.0 | 0.5 | X |
| | 5.0 | 0.8 | X |
| | 5.0 | 1 | X |
| 0.8 | 1.0 | 0.3 | X |
| | 1.0 | 0.5 | X |
| | 1.0 | 0.8 | X |
| | 1.8 | 0.3 | Δ |
| | 1.8 | 0.4 | ◎ |
| | 1.8 | 0.6 | X |
| | 3.5 | 0.3 | X |
| | 3.5 | 0.5 | X |
| | 3.5 | 0.8 | X |
| | 5.0 | 0.3 | X |
| | 5.0 | 0.5 | X |
| | 5.0 | 0.8 | X |
| 1.5 | 1.0 | 0 | X |
| | 1.0 | 0.3 | ◎ |
| | 1.0 | 0.5 | X |
| | 1.5 | 0 | X |
| | 1.5 | 0.35 | Δ |
| | 1.5 | 0.45 | X |
| | 2.0 | 0.2 | X |
| | 2.0 | 0.35 | X |
| | 2.0 | 0.5 | X |

TABLE 4

(Narrow Surface)

| Casting Rate Vc m/min | First Inclined Surface TRu %/m | Second Inclined Surface TRd %/m | Evaluation |
|---|---|---|---|
| 0.6 | 1 | 0.3 | X |
| | 1 | 0.5 | X |
| | 1 | 0.8 | X |
| | 2 | 0.3 | Δ |
| | 2 | 0.5 | ◎ |
| | 2 | 0.8 | X |
| | 3 | 0.5 | X |
| | 3 | 0.8 | X |
| | 3 | 1 | X |
| | 5 | 0.5 | X |
| | 5 | 0.8 | X |
| | 5 | 1 | X |

TABLE 4-continued

| Casting Rate Vc m/min | (Narrow Surface) First Inclined Surface TRu %/m | Second Inclined Surface TRd %/m | Evaluation |
|---|---|---|---|
| 0.8 | 1 | 0.3 | X |
| | 1 | 0.5 | X |
| | 1 | 0.8 | X |
| | 2 | 0.3 | ○ |
| | 2 | 0.5 | ◎ |
| | 2 | 0.8 | X |
| | 2.5 | 0.5 | X |
| | 2.5 | 0.8 | X |
| | 2.5 | 1 | X |
| | 5 | 0.5 | X |
| | 5 | 0.8 | X |

TABLE 4-continued

| Casting Rate Vc m/min | (Narrow Surface) First Inclined Surface TRu %/m | Second Inclined Surface TRd %/m | Evaluation |
|---|---|---|---|
| | 5 | 1 | X |
| 1.5 | 0.3 | 0 | X |
| | 0.3 | 0.12 | X |
| | 0.3 | 0.5 | X |
| | 0.8 | 0 | Δ |
| | 0.8 | 0.26 | ◎ |
| | 0.8 | 0.8 | X |
| | 1.5 | 0.5 | X |
| | 1.5 | 0.8 | X |
| | 1.5 | 1 | X |

TABLE 5

| Casting Rate Vc m/min | Discharge Port Angle θ° | Discharge Port Area $mm^2$ | Surface Fluctuation Drift | Deckel | [Comprehensive Evaluation] Degree of Solidification Delay Corner Craking | Inclination Rate [Substantially Center Value] | |
|---|---|---|---|---|---|---|---|
| 0.5~0.7 | −10 | 1800 | X | ○ | X | Vc = 0.5,0.6[m/min]: | Inclination rate of first inclined surface TRu 2.0%/m |
| | | 2500 | X | ○ | X | | Inclination rate of second inclined surface TRd 0.55%/m |
| | −5 | 1800 | X | ○ | X | | |
| | | 2500 | ○ | ○ | ◎ | Vc = 0.7[m/min]: | Inclination rate of first inclined surface TRu 1.8%/m |
| | 10 | 3600 | ○ | ○ | ◎ | | Inclination rate of second inclined surface TRd 0.5%/m |
| | | 4000 | ○ | ○ | ◎ | | |
| | 20 | 4000 | ○ | ○ | ◎ | | |
| | 30 | 4000 | ○ | ○ | ◎ | | |
| | 35 | 6400 | ○ | X | X | | |
| 0.7~1.0 | −10 | 1800 | X | ○ | X | Vc = 0.7[m/min]: | Inclination rate of first inclined surface TRu 1.8%/m |
| | | 2500 | X | ○ | X | | Inclination rate of second inclined surface TRd 0.5%/m |
| | −5 | 1800 | X | ○ | X | | |
| | | 2500 | ○ | ○ | ◎ | | |
| | 10 | 3600 | ○ | ○ | ◎ | Vc = 0.9[m/min]: | Inclination rate of first inclined surface TRu 1.6%/m |
| | | 4000 | ○ | ○ | ◎ | | Inclination rate of second inclined surface TRd 0.45%/m |
| | 20 | 4000 | ○ | ○ | ◎ | | |
| | 30 | 4000 | ○ | ○ | ◎ | | |
| | 35 | 6400 | ○ | X | X | | |
| 1.0 or more | −10 | 1800 | X | ○ | X | Vc = 1.0[m/min]: | Inclination rate of first inclined surface TRu 1.5%/m |
| | | 2500 | X | ○ | X | | Inclination rate of second inclined surface TRd 0.42%/m |
| | −5 | 1800 | X | ○ | X | | |
| | | 2500 | X | ○ | X | | |
| | 10 | 3600 | ○ | ○ | ◎ | Vc = 1.5[m/min]: | Inclination rate of first inclined surface TRu 0.8%/m |
| | | 4000 | ○ | ○ | ◎ | | Inclination rate of second inclined surface TRd 0.30%/m |
| | 20 | 4000 | ○ | ○ | ◎ | | |
| | 30 | 4000 | ○ | ○ | ◎ | | |
| | 35 | 6400 | ○ | X | X | | |

TABLE 6

| Casting Rate Vc m/min | Discharge Port Angle θ° | Discharge Port Area $mm^2$ | Surface Fluctuation Drift | Deckel | [Comprehensive Evaluation] Degree of Solidification Delay Corner Craking | Inclination rate [Upper limit value] | |
|---|---|---|---|---|---|---|---|
| 0.5~0.7 | −10 | 1800 | X | ○ | X | Vc = 0.6[m/min]: | Inclination rate of first inclined surface TRu 2.3%/m |
| | | 2500 | X | ○ | X | | Inclination rate of second inclined surface TRd 0.60%/m |
| | −5 | 1800 | X | ○ | X | | |
| | | 2500 | ○ | ○ | ◎ | Vc = 0.7[m/min]: | Inclination rate of first inclined surface TRu 2.2%/m |
| | 10 | 3600 | ○ | ○ | ◎ | | Inclination rate of second inclined surface TRd 0.55%/m |
| | | 4000 | ○ | ○ | ◎ | | |
| | 20 | 4000 | ○ | ○ | ◎ | | |
| | 30 | 4000 | ○ | ○ | ◎ | | |
| | 35 | 6400 | ○ | X | X | | |
| 0.7~1.0 | −10 | 1800 | X | ○ | X | Vc = 0.7[m/min]: | Inclination rate of first inclined surface TRu 2.2%/m |
| | | 2500 | X | ○ | X | | Inclination rate of second inclined surface TRd 0.55%/m |
| | −5 | 1800 | X | ○ | X | | |
| | | 2500 | ○ | ○ | ◎ | | |
| | 10 | 3600 | ○ | ○ | ◎ | Vc = 0.9[m/min]: | Inclination rate of first inclined surface TRu 1.8%/m |
| | | 4000 | ○ | ○ | ◎ | | Inclination rate of second inclined surface TRd 0.51%/m |
| | 20 | 4000 | ○ | ○ | ◎ | | |
| | 30 | 4000 | ○ | ○ | ◎ | | |
| | 35 | 6400 | ○ | X | X | | |
| 1.0 or more | −10 | 1800 | X | ○ | X | Vc = 1.0[m/min]: | Inclination rate of first inclined surface TRu 1.7%/m |
| | | 2500 | X | ○ | X | | Inclination rate of second inclined surface TRd 0.5%/m |
| | −5 | 1800 | X | ○ | X | | |
| | | 2500 | X | ○ | X | | |
| | 10 | 3600 | ○ | ○ | ◎ | Vc = 1.5[m/min]: | Inclination rate of first inclined surface TRu 1.0%/m |
| | | 4000 | ○ | ○ | ◎ | | Inclination rate of second inclined surface TRd 0.28%/m |
| | 20 | 4000 | ○ | ○ | ◎ | | |
| | 30 | 4000 | ○ | ○ | ◎ | | |
| | 35 | 6400 | ○ | X | X | | |

TABLE 7

| Casting Rate Vc m/min | Discharge Port Angle θ° | Discharge Port Area $mm^2$ | Surface Fluctuation Drift | Deckel | [Comprehensive Evaluation] Degree of Solidification Delay Corner Craking | Inclination rate [Lower limit value] | |
|---|---|---|---|---|---|---|---|
| 0.5~0.7 | −10 | 1800 | X | ○ | X | Vc = 0.6[m/min]: | Inclination rate of first inclined surface TRu 1.6%/m |
| | | 2500 | X | ○ | X | | Inclination rate of second inclined surface TRd 0.43%/m |
| | −5 | 1800 | X | ○ | X | | |
| | | 2500 | ○ | ○ | ◎ | Vc = 0.7[m/min]: | Inclination rate of first inclined surface TRu 1.5%/m |
| | 10 | 3600 | ○ | ○ | ◎ | | Inclination rate of second inclined surface TRd 0.41%/m |
| | | 4000 | ○ | ○ | ◎ | | |
| | 20 | 4000 | ○ | ○ | ◎ | | |
| | 30 | 4000 | ○ | ○ | ◎ | | |
| | 35 | 6400 | ○ | X | X | | |
| 0.7~1.0 | −10 | 1800 | X | ○ | X | Vc = 0.7[m/min]: | Inclination rate of first inclined surface TRu 1.5%/m |
| | | 2500 | X | ○ | X | | Inclination rate of second inclined surface TRd 0.41%/m |
| | −5 | 1800 | X | ○ | X | | |
| | | 2500 | ○ | ○ | ◎ | | |

TABLE 7-continued

| Casting Rate Vc m/min | Discharge Port Angle θ° | Discharge Port Area $mm^2$ | Surface Fluctuation Drift | Deckel | [Comprehensive Evaluation] Degree of Solidification Delay Corner Craking | Inclination rate [Lower limit value] |
|---|---|---|---|---|---|---|
| | 10 | 3600 | ○ | ○ | ◎ | Vc = 0.9[m/min]: Inclination rate of first inclined surface TRu 1.4%/m |
| | | 4000 | ○ | ○ | ◎ | Inclination rate of second inclined surface TRd 0.39%/m |
| | 20 | 4000 | ○ | ○ | ◎ | |
| | 30 | 4000 | ○ | ○ | ◎ | |
| | 35 | 6400 | ○ | X | X | |
| 1.0 or more | −10 | 1800 | X | ○ | X | Vc = 1.0[m/min]: Inclination rate of first inclined surface TRu 1.3%/m |
| | | 2500 | X | ○ | X | Inclination rate of second inclined surface TRd 0.39%/m |
| | −5 | 1800 | X | ○ | X | |
| | | 2500 | X | ○ | X | |
| | 10 | 3600 | ○ | ○ | ◎ | Vc = 1.5[m/min]: Inclination rate of first inclined surface TRu 0.7%/m |
| | | 4000 | ○ | ○ | ◎ | Inclination rate of second inclined surface TRd 0.25%/m |
| | 20 | 4000 | ○ | ○ | ◎ | |
| | 30 | 4000 | ○ | ○ | ◎ | |
| | 35 | 6400 | ○ | X | X | |

We claim:

1. A continuous casting method for continuously casting a bloom having a substantially rectangular section, with the length of each side constituting the sectional circumference being not less than 120 mm and an aspect ratio being not less than 1.0 to not more than 2.0, at a casting rate (Vc:[m/min]) of not less than 0.5 [m/min] to not more than 2.0 [m/min], using a mold powder to be added into a mold, which is adjusted to have a total content of CaO component and $SiO^2$ component of not less than 50 wt % and a content of F component of not more than 11 wt %, the method comprising:

providing, on the inside of said mold, a first inclined surface and a second inclined surface differed in inclination rate in order from top to down;

setting the inclination rate of said first inclined surface (TRu: [%/m]) and the inclination rate of said second inclined surface (TRd: [%/m]) within ranges satisfying the following expressions (1) and (2) when the basicity of said mold powder is less than 1.1, or the solidification temperature of said mold powder is lower than 1100° C.;

setting the inclination rate of said first inclined surface and the inclination rate of said second inclined surface within ranges satisfying the following expressions (3) and (4) when the basicity of said mold powder is 1.1 or more, and the solidification temperature of said mold powder is 1100° C. or higher;

setting the boundary position between said first inclined surface and said second inclined surface to be distant downwardly not less than 0.2 m and not more than 0.4 m based on the upper end of the mold;

boring at least two molten steel discharge ports in lower end portions of a dipping nozzle for pouring molten steel to said mold;

setting the pore area of said molten steel discharge ports to not less than 2500 $mm^2$ to less than 6400 $mm^2$;

setting the discharge angle of said molten steel discharge ports obliquely upward, based on the horizontal, to from not less than 0° to not more than 50 or obliquely downward to from not less than 0° to not more than 35° when said casting rate is not more than 0.7 [m/min]; and setting the discharge angle of said molten steel discharge ports obliquely downward, based on the horizontal, to from not less than 10° to not more than 35° when the casting rate is larger than 0.7 [m/min].

$$4.4-1.95\times Vc \leqq TRu \leqq 6.06-2.5\times Vc \quad (1)$$

$$0.92-0.3\times Vc \leqq TRd \leqq 1.18-0.4\times Vc \quad (2)$$

$$2.23-1.05\times Vc \leqq TRu \leqq 3.18-1.4\times Vc \quad (3)$$

$$0.55-0.2\times Vc \leqq TRd \leqq 0.77-0.25\times Vc \quad (4).$$

2. The continuous casting method according to claim 1, comprising the steps of continuously casting a bloom having a substantially rectangular section using a single mold and with at least first and second casting rates Vc, wherein when the range of inclination rates of the first or second inclined surfaces determined based on the second casting rate overlaps with the range of inclination rates of the first or second inclined surfaces determined based on the first casting rate, the inclination rate of said first inclined surface or said second inclined surface is set within said overlap of the ranges, and when the range of inclination rates of the first or second inclined surfaces determined based on the second casting rate does not overlap with the range of inclination rates of the first or second inclined surfaces determined based on the first casting rate, the inclination rate of said first inclined surface or said second inclined surface is determined based on:

a larger casting rate being prioritized as the range of inclination rate of said first inclined surface or said second inclined surface, a range satisfying the expression (3) being prioritized over a range satisfying the expression (1), and a range satisfying the expression (4) being prioritized over a range satisfying the expression (2).

* * * * *